US010926914B2

(12) United States Patent
Dunivan et al.

(10) Patent No.: US 10,926,914 B2
(45) Date of Patent: Feb. 23, 2021

(54) PACKAGING APPARATUS AND METHOD

(71) Applicants: Steve Dunivan, Amarillo, TX (US); Ricky Jay Hudson, Amarillo, TX (US); Colby Shane Butcher, Bushland, TX (US)

(72) Inventors: Steve Dunivan, Amarillo, TX (US); Ricky Jay Hudson, Amarillo, TX (US); Colby Shane Butcher, Bushland, TX (US)

( * ) Notice: Subject to any disclaimer, the term of this patent is extended or adjusted under 35 U.S.C. 154(b) by 741 days.

(21) Appl. No.: 14/794,104

(22) Filed: Jul. 8, 2015

(65) Prior Publication Data

US 2015/0306835 A1 Oct. 29, 2015

Related U.S. Application Data

(63) Continuation-in-part of application No. 13/494,571, filed on Jun. 12, 2012, now Pat. No. 9,162,779, which (Continued)

(51) Int. Cl.
*B65D 5/66* (2006.01)
*B65B 51/00* (2006.01)
(Continued)

(52) U.S. Cl.
CPC ..... *B65D 5/6632* (2013.01); *B65B 7/20* (2013.01); *B65B 51/00* (2013.01); *B31B 50/0042* (2017.08); *B31B 50/52* (2017.08); *B31B 50/734* (2017.08); *B31B 50/81* (2017.08); *B31B 2105/00* (2017.08); *B31B 2110/35* (2017.08); *B31B 2120/10* (2017.08); *B31B 2120/60* (2017.08); *B65D 77/0426* (2013.01); *B65D 2577/043* (2013.01)

(58) Field of Classification Search
CPC ... B31B 1/20; B31B 2105/00; B31B 50/0042; B31B 2120/60; B31B 50/734; B31B 2110/35; B31B 50/81; B31B 2120/10; B31B 50/52; B65B 7/20; B65B 51/00; B65D 5/6632; B65D 77/0426; B65D 2577/043
USPC ..... 53/491
See application file for complete search history.

(56) References Cited

U.S. PATENT DOCUMENTS 2,660,012 A * 11/1953 Boyce ..... B65B 7/24 53/377.5
2,727,675 A * 12/1955 Mairs ..... B65D 5/323 229/122.24
(Continued)

*Primary Examiner* — Sameh Tawfik
(74) *Attorney, Agent, or Firm* — Braxton Perrone, PLLC; Bobby W. Braxton; Gregory Perrone

(57) ABSTRACT

A method and apparatus are shown for securing a top for a cardboard carton where the carton has a bottom wall and integral sidewalls, an initially open interior and initially open top flaps with outwardly extending ears. The top flaps are folded to a carton closing position which closes off the initially open interior of the cardboard carton. The ears are also folded to a position in contact with the sidewalls of the carton. A set of punches are aligned with the folded ears of the carton and are actuated to force a first layer of cardboard from a respective top flap through an underlying region of the carton sidewall. A set of platens are located so as to underlie and reinforce the sidewalls of the carton as the punching operation takes place.

10 Claims, 10 Drawing Sheets

Related U.S. Application Data is a continuation-in-part of application No. 13/161,164, filed on Jun. 15, 2011, now Pat. No. 8,789,348.

(51) Int. Cl.

| | |
|---|---|
| ***B65B 7/20*** | (2006.01) |
| *B65D 77/04* | (2006.01) |
| *B31B 50/00* | (2017.01) |
| *B31B 105/00* | (2017.01) |
| *B31B 110/35* | (2017.01) |
| *B31B 50/52* | (2017.01) |
| *B31B 120/60* | (2017.01) |
| *B31B 50/81* | (2017.01) |
| *B31B 120/10* | (2017.01) |
| *B31B 50/73* | (2017.01) |

(56) References Cited

U.S. PATENT DOCUMENTS 2,937,486 A * 5/1960 Ackley ..... B65B 7/24 493/137
3,055,156 A * 9/1962 Fox ..... B67B 3/14 53/363
3,394,529 A * 7/1968 Greenway ..... B65B 7/2842 53/329
3,462,914 A * 8/1969 Dorfmann ..... B65B 7/22 53/201
3,779,448 A * 12/1973 Wootten ..... B65D 13/04 229/125.01
3,913,300 A * 10/1975 Benzing ..... B65B 7/2807 493/169
3,951,049 A * 4/1976 Brackmann ..... B65B 7/2807 493/148
4,240,337 A * 12/1980 Casutt ..... B31B 50/00 493/137
4,441,303 A * 4/1984 Langen ..... B65B 7/24 52/374
4,584,818 A * 4/1986 Plaskett ..... B65B 7/24 493/136
5,066,269 A * 11/1991 Center ..... B31B 50/00 493/183
5,369,939 A * 12/1994 Moen ..... B65B 7/285 53/306
5,501,394 A * 3/1996 Eno ..... B29C 65/18 229/125.42
6,135,347 A * 10/2000 Mueller ..... B65D 5/0227 206/232
6,234,385 B1 * 5/2001 Espinoza ..... B65D 5/2038 229/122
6,250,543 B1 * 6/2001 Saijo ..... B29C 66/306 116/205
7,062,891 B2 * 6/2006 Kruger ..... B31B 50/00 53/376.5
7,121,453 B2 * 10/2006 Nass ..... B65D 5/0045 229/177
9,073,664 B2 * 7/2015 Justice ..... B65D 5/4608
2007/0000984 A1 * 1/2007 McClure ..... B65D 5/443 229/143
2008/0149696 A1 * 6/2008 Kuhn ..... B65D 5/008 229/142

* cited by examiner

PACKAGING APPARATUS AND METHOD

CROSS-REFERENCE TO RELATED APPLICATIONS

This application is a continuation-in-part of earlier filed Ser. No. 13/494,571 filed Jun. 12, 2012, which is a continuation-in-part of earlier filed Ser. No. 13/161,164, filed Jun. 15, 2011, entitled "Packaging Apparatus and Method", by the same inventors, the entirety of both of which are incorporated herein by reference.

BACKGROUND OF THE INVENTION

Technical Field

The present invention relates generally to packaging machinery and methods and, more specifically, to a method and apparatus for securing a lid to a cardboard box that has previously been loaded with a product.

Description of Related Art

A large number of machines exist at the present time which are capable of applying and securing lids to open top cartons as well as for folding and securing the initially open top flap or flaps of cartons filled with product. The existing devices include machines which serve to apply and form prescored lids about the openings of open-top cartons. Quite frequently, lids are presented to filled cartons in the form of prescored blanks having planar configurations. When the carton is of an open-top variety the blanks are extended across the carton top openings and then down-folded along score lines in a manner such that the peripheral portions of the lids engage the vertical side walls of the cartons.

In another type of packaging method, the top closure is provided in the form of a top flap or flaps developed from and integral with the container. Since the closure is integrally formed with the container, a mere folding operation is required to position the top flap or flaps over the initially open top.

In either type of packaging operation, it is customary to move empty cartons along a path on some type of conveyor system or by gravity in a chute. The cartons are either provided with closed integral side walls in an earlier carton forming operation, or the carton is formed as it moves down the conveyor line. As the cartons proceed along the path, product is placed in the carton. In the first method described above, a lid is applied to the open-top carton and the lid peripheral edges are folded and secured to the carton sidewalls. In the second of the previously described methods, the carton has an integral open top flap or flaps. The open top flaps of the carton are folded to make a closed top wall for the carton and the folded flaps are then secured to the sidewalls of the carton.

It is highly desirable that the previously described loading, closing and fastening operations proceed at a high rate of production. Continuous and reliable high speed loading of the cartons, applying of lids and closing of the top flaps is generally achieved at the present time, but the step of securing the carton top slows down the entire operation. For example, it is common at the present time to fasten the lid or top flaps by gluing them to the side walls of the carton. In addition to the start up and break down delays involved in handling glue, which is sticky and susceptible of change in viscosity during periods of inactivity, extra traveling space must be provided along the loading path to permit adequate time for the glue to set up and cure. This can result in a lower production rate. Perhaps more importantly, the cost of the glue used in the step of securing the carton top is a major expense in the overall packaging operation.

In order to overcome the disadvantages of gluing, cartons have been devised with tongues on certain flaps which cooperate with notches or grooves in other flaps of the carton. The tongues are engaged and forced into a locking fit in the grooves or notches in order to secure the carton top. See, for example, U.S. Pat. No. 2,937,486, to Ackley, issued May 24, 1960. This approach decreases some of the difficulties associated with gluing. However, the Ackley process continues to present certain difficulties. Because the carton body and flaps were pre-punched, it was necessary to insure that the notches and flaps were precisely aligned at all times. Otherwise, the punching procedure may tend to bruise or buckle the cartons because of the misalignment, or the closing operation might fail entirely.

It is therefore an object of the present invention to provide an improved apparatus and method for folding and securing the initially open flaps of an open-top carton to the main body of the carton to thereby provide a secure closure for the carton.

Another object of the invention is to provide such an apparatus and method which can be used to secure separate carton lids to an open top carton.

It is another object of the present invention to provide a device of the character stated which is extremely versatile in usage being adapted for integration with a variety of assembly line operations and, hence, be readily incorporated into existing equipment without requiring costly modifications.

It is a further object of the present invention to provide a device of the character stated which incorporates a minimum of additional components and which is readily adapted for automatic operation in cooperation with any of a number of suitable hydraulic or pneumatic power drive sources and which is, hence, capable of operating at predetermined rates commensurate with a particular packaging operation so that it does not impede or restrict the designed volume flow of the related equipment.

It is a still further object of the present invention to provide a device of the character stated which can be economically manufactured, which is resistant to breakdown, and which is extremely durable and reliable in usage.

Additional objects, features and advantages will be apparent in the written description which follows.

SUMMARY

The apparatus of the present invention can be used in a packaging method which obviates the above difficulties and meets the foregoing objects. In one preferred form, the apparatus is used for folding and securing a top for a cardboard carton where the carton has a bottom wall and integral sidewalls defining an initially open interior and initially open top flaps with outwardly extending ears, the initially open top flaps being integrally formed with a first pair of opposing sidewalls of the carton. The apparatus forms a part of an assembly line mechanism and is located downstream of a carton closing station which receives a cardboard carton with top flaps which have been folded downwardly from an initially open position to a carton closing position which closes off the initially open interior of the cardboard carton. The outwardly extending ears of the now closed top flaps are also in a position in contact with a second set of opposing sidewalls of the carton intermediate the first set of opposing sidewalls. Alternatively, the apparatus may form a part of the carton closing station.

The assembly line mechanism includes a carton punching mechanism for punching and forcing a first layer of cardboard from the ear of a respective top flap through an associated second layer of an underlying sidewall of the carton, whereby the first layer of cardboard forms a retainer for the respective top flap ear to thereby secure the ear and flap to the respective sidewall of the carton. The carton punching mechanism is carried by a vertically movable carriage. In one version of the invention, the punching mechanism includes a horizontal shaft carried between a pair of spaced apart trunnions, the shaft also carrying a set of punches which are alignable with the folded ears of the top flap. The punches terminate in die elements. In one version of the invention, the punches are rotatable about the shaft. In another version of the invention, the punches are again carried by the vertically movable carriage. However, in this version, the punch elements are movable between retracted and extended positions along a horizontal axis. The vertically movable carriage also carries a pair of spaced apart, vertically extending platens. The platens are spaced apart a selected distance so as to underlie the inwardly extending die elements of the punches when the punches are actuated to punch the carton. The platens have window openings located in such a way as to receive the die elements as the carton is punched.

A suitable power source is provided for effecting vertical movement of the traveling carriage and for effecting movement of the punches. The traveling carriage acts as a vertical elevation mechanism which effects vertical movement of the punches along a vertical path of travel with respect to the stationary carton. The platens are suitably spaced so as to puncture the carton top flaps and enter the carton interior upon vertical movement of the carton punching mechanism, prior to the punching operation, as the carton closing operation proceeds.

The previously described apparatus is used as an assembly line mechanism in the practice of the method of the invention to securely engage the initially open top flaps on a cardboard carton, as will be described in greater detail in the written description which follows. The apparatus can also be used to engage a separate, non-integrally formed lid with an open top cardboard carton.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
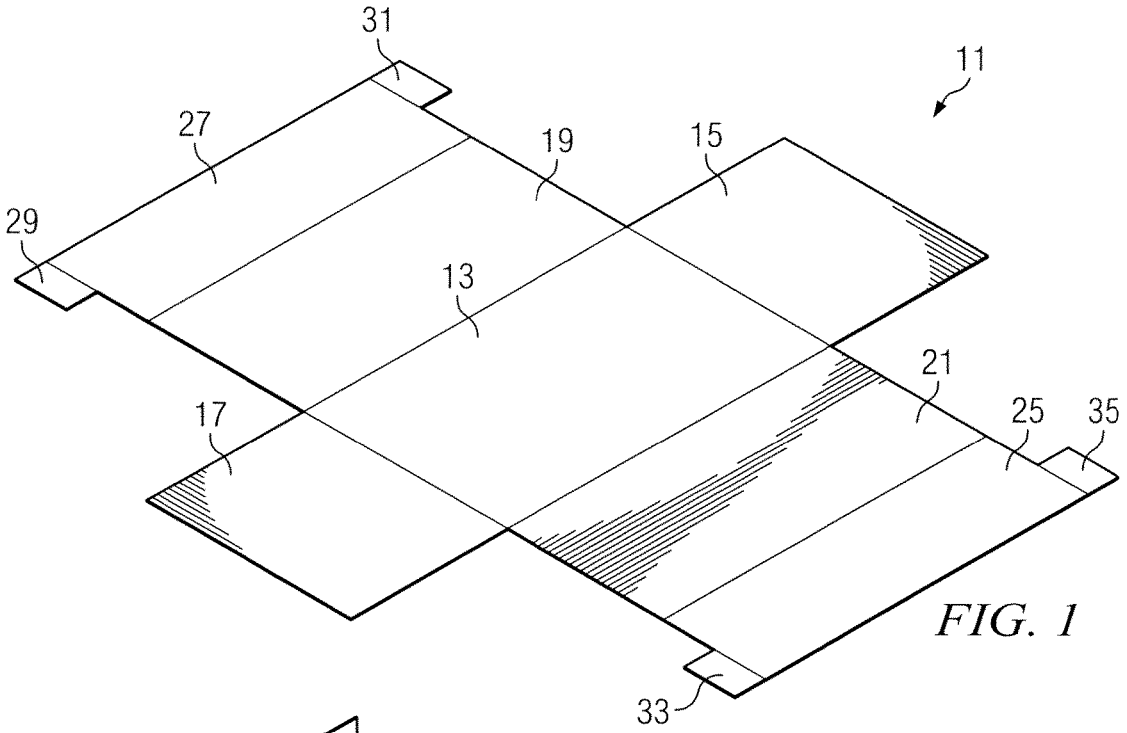
FIG. 1 is an elevational view of a cardboard carton blank of the type used in the practice of the method of the invention.

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the important features of the invention. The examples used herein are intended merely to facilitate an understanding of ways in which the invention herein may be practiced and to further enable those of skill in the art to practice the embodiments herein. Accordingly, the examples should not be construed as limiting the scope of the claimed invention.

The lid closure apparatus of the invention can be used in a variety of packaging assembly lines. These packaging assembly lines include both those which use separate lids and those which use cartons with integrally formed initially open flaps which are later folded and secured to form a top for the carton. Both types of packaging lines are well known in the industry and are commonly used, for example, in packaging milk cartons or jugs for shipment. The present discussion will not include a detailed explanation of the steps in preparing the carton for the actual puncture and engagement steps, since such processes and devices used therein are well known in the relevant arts. A number of prior art packaging lines are known for accomplishing this task.

For an example of the first type of packaging line, the reader is referred to U.S. Pat. No. 5,369,939, issued to Lewis et al., on Jun. 9, 1987, by way of example, which describes a packaging framework having a high speed endless belt conveyor passing through a lidding station. A gate at the entrance into the conveyor is cyclically opened and closed to periodically admit a preloaded carton into the lidding station. Within the lidding station, an elongate brake shoe incorporates a stop member to arrest the carton in an indexed position. The carton is laterally restrained between a pair of fixed guides on opposite sides of the conveyor belt and, after the carton has been arrested by the stop blocks of the elongated brake shoes, a pair of back blocks are laterally swung into contact with the trailing end of the indexed carton.

Each of the brake shoes is mounted on a pivotal axis paralleling the brake shoe and the adjacent carton bottom edge. A double pneumatic cylinder is used to raise the carton in two steps from the retracted position into intermediate and fully elevated positions. In the intermediate position, the brake shoes lift the carton from the conveyor and serve to gradually decelerate the carton until it engages the downstream stop blocks, the carton sliding on the horizontal flanges of the brake shoes. In the fully extended position the carton is further lifted away from the conveyer belt and raised into a fully indexed position and clamped between vertical flanges of the pair of shoes in readiness for application of a lid thereto.

The lidding station has a lateral frame section comprising a magazine for preformed blanks that have been cut and scored in readiness to be formed as a lid around the upper end of the indexed carton. The lid blanks are individually retrieved from a stack thereof by a vacuum cup assembly to deliver the lid blank onto a shuttle mechanism that transports the lid blank through a glue application station into an indexed position within a fold and compression sub-assembly. The fold and compression assembly includes an opposite pair of longitudinally grooved guide rails to receive opposite edges of a lid blank as well as a pair of stops to arrest the blank in the indexed position. In the indexed position of the lid, the fold lines of its marginal flaps and tabs are in registration with the upper end of the elevated and loaded carton. The fold and compression assembly is mounted for vertical reciprocation by means of a linear thruster on the machine framework and acts to apply a compressive force against the top surface of the lid and onto upper edge portions of the carton corner posts so that the lid can be glued to the carton.

The details of the above process are merely intended to describe a typical lidding operation for packaging lines having open top cartons and separate lids and should not be deemed limiting. The closure station of the invention would typically be incorporated into the packaging line after the lid has been positioned on the open top carton.

An example of the second type of packaging line which uses a carton with integrally formed, initially open top flaps is shown, by way of example, in U.S. Pat. No. 2,937,486, to Ackley, issued May 24, 1960. In that packaging line, empty cartons are moved along a path on a conveyor. The cartons are provided with closed integral side walls and open top flaps. As the cartons proceed along the path, cylindrical cans are placed in the carton, the top flaps of the carton are folded to make a closed top for the carton, and the top flaps are then secured to seal the carton.

Again, the details of this process are merely intended to be illustrative of the second type packaging line in which the lid is integral with the carton sidewalls and should not be deemed limiting.

Figure 2:
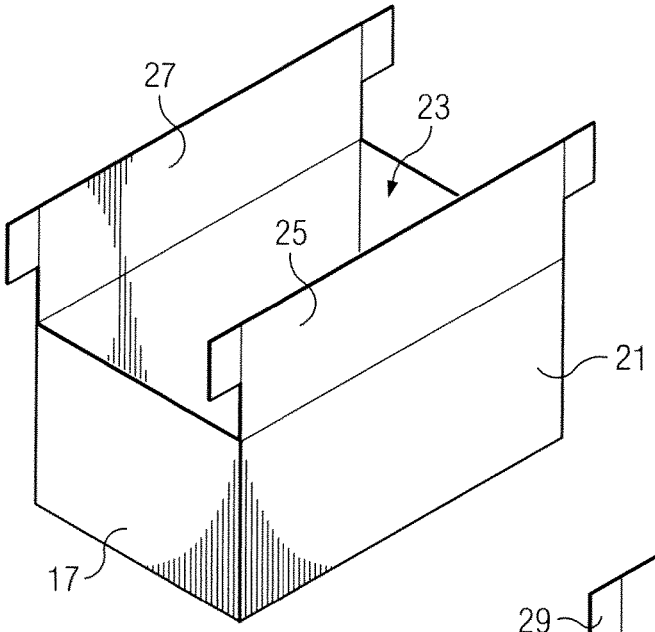
FIG. 2 is a perspective view of the same carton blank which has been folded and sealed to form a carton having upstanding sidewalls and open top flaps.

Turning now to FIG. 1, there is shown a cardboard carton blank of the type used in the practice of the present invention, designated generally as 11. The blank 11 has what will become a bottom wall 13, and pairs of opposing sidewalls 15, 17 and 19, 21. The integral sidewalls 15, 17 and 19, 21 define an initially open interior (designated generally as 23 in FIG. 2) when the carton body is assembled. Note that the opposing sidewalls 19, 21 have initially open top flaps 25, 27 at an outer extent thereof. The flaps are integrally formed with the first pair of opposing sidewalls of the carton 19, 21. Each of the flaps has a pair of spaced-apart, initially outwardly extending ears 29, 31 and 33, 35. When the carton body has been assembled, as shown in FIG. 2, the initially open top flaps 19, 21 are vertically disposed. While four outwardly extending ears 29, 31, 33, 35 have been depicted, this is for illustrative purposes only. In other embodiments as few as one ear or as much as five or more ears can be utilized. Furthermore, while a single blank 11 has been shown and discussed, this is for illustrative purposes only and shout not be deemed limiting. In other embodiments the system and method discussed herein can be utilized on boxes which require two or more separate pieces. For example, one blank will be folded to make the box bottom whereas another blank will be utilized for the top. Furthermore, while a standard rectangular box with six-sides has been shown in the figures, this is for illustrative purposes only and should not be deemed limiting. The system and method disclosed herein can be practiced on boxes of any shape including but not limited to circular, cylindrical, and virtually any shape that shipping or storage containers typically utilize.

Figure 3:
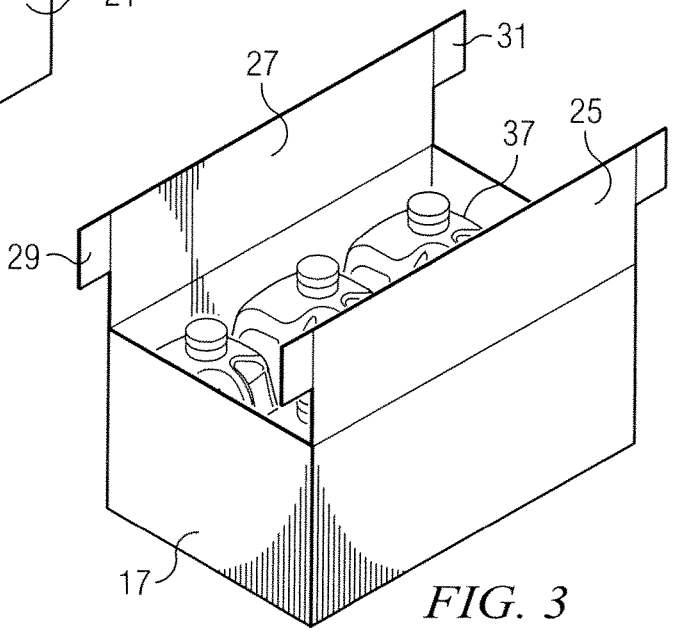
FIG. 3 is a view of the carton of FIG. 2 filled with milk jugs and with the top flaps in the open, unengaged position.
Figure 4:
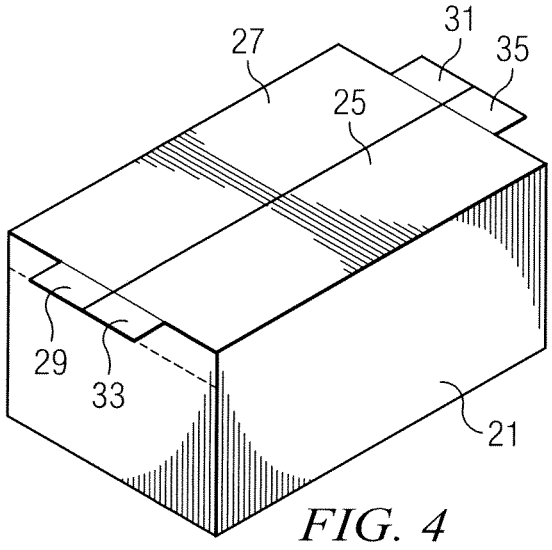
FIG. 4 shows the next step in forming a closed carton in which the initially open top flaps of the carton are folded down to form a closed top for the carton.
Figure 5:
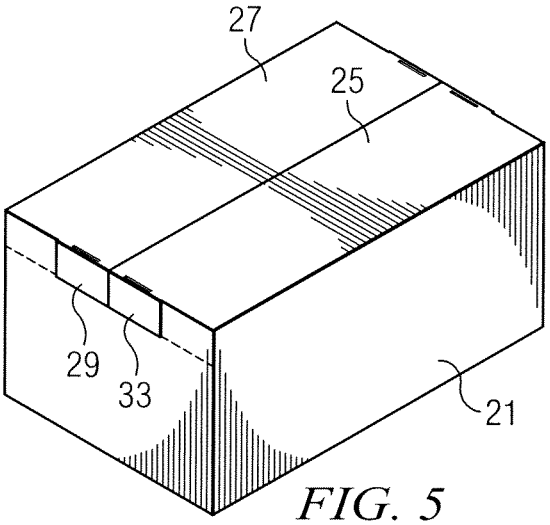
FIG. 5 is a view of the next step in forming a closed carton in which the ears of the initially open top flaps are punched and engaged with the carton sidewalls.

FIG. 3 shows the carton which has been filled with plastic milk jugs 37. In a typical milk carton packaging operation, the carton body is formed from the blank shown in FIG. 1. As the carton passes down a conveyor, the milk jugs 37 are positioned in the carton interior at a fill station. At a subsequent station in the packaging line, the carton top flaps are folded down to the position shown in FIG. 4. A line of glue would then typically be applied along the carton sidewalls, as indicated by dotted lines in FIGS. 4 and 5. The initially outwardly extending ears of the top flaps would then be folded down, as shown in FIG. 5, and pressure would be applied to seal the ears 29, 33 as the glue cured.

Figure 6:
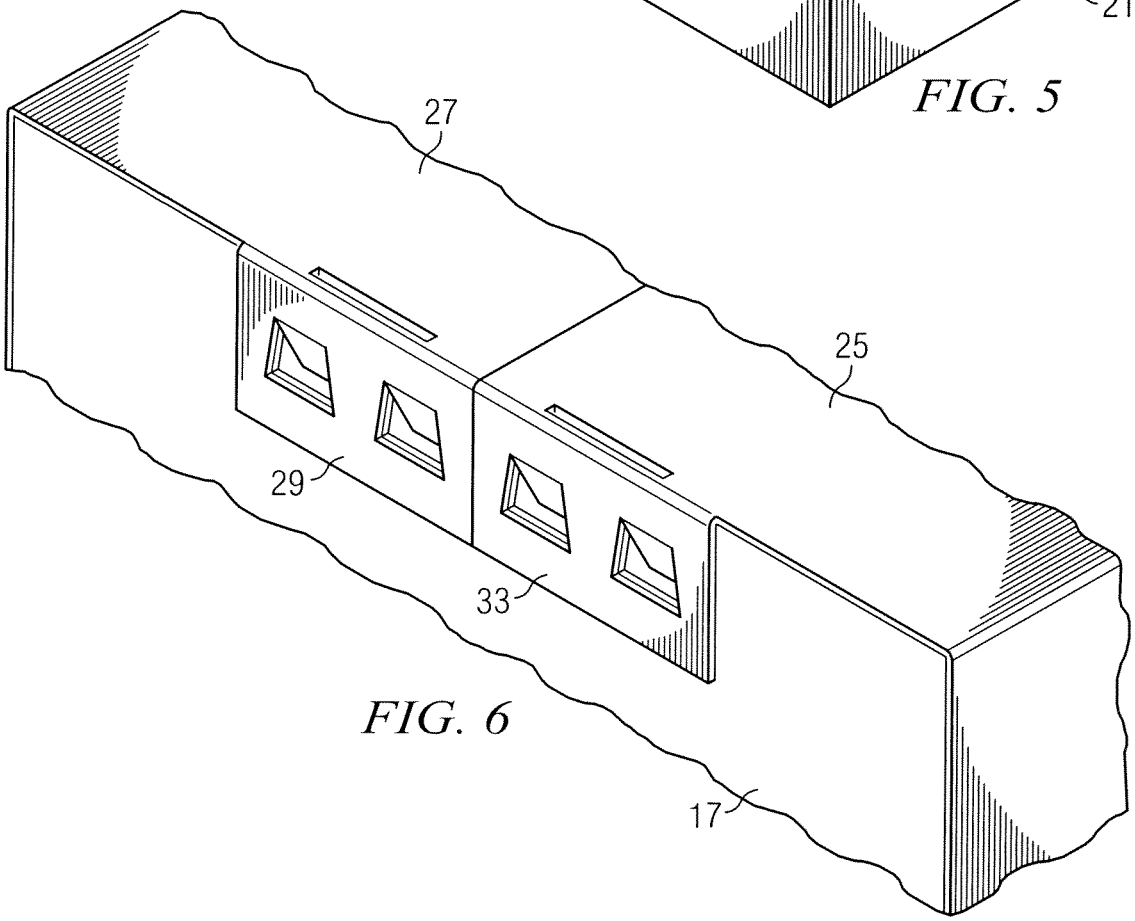
FIG. 6 is a close up view of the punched and engaged region of the carton.

All of the above steps are conventional in the industry and the associated machinery used to accomplish these tasks will not be discussed further, except as might bear on the closure station which forms the essence of the present invention. FIG. 6 shows a cardboard carton which has been sealed using the method and apparatus of the present invention, rather than using a gluing station, as practiced in the prior art. The closure station of the invention would thus follow the steps in the packaging process indicated in FIGS. 4 and 5 where the top flaps and associated ears have been folded down. However, the closure station of the invention would take the place of the glue application illustrated schematically in FIGS. 4 and 5.

Figure 7:
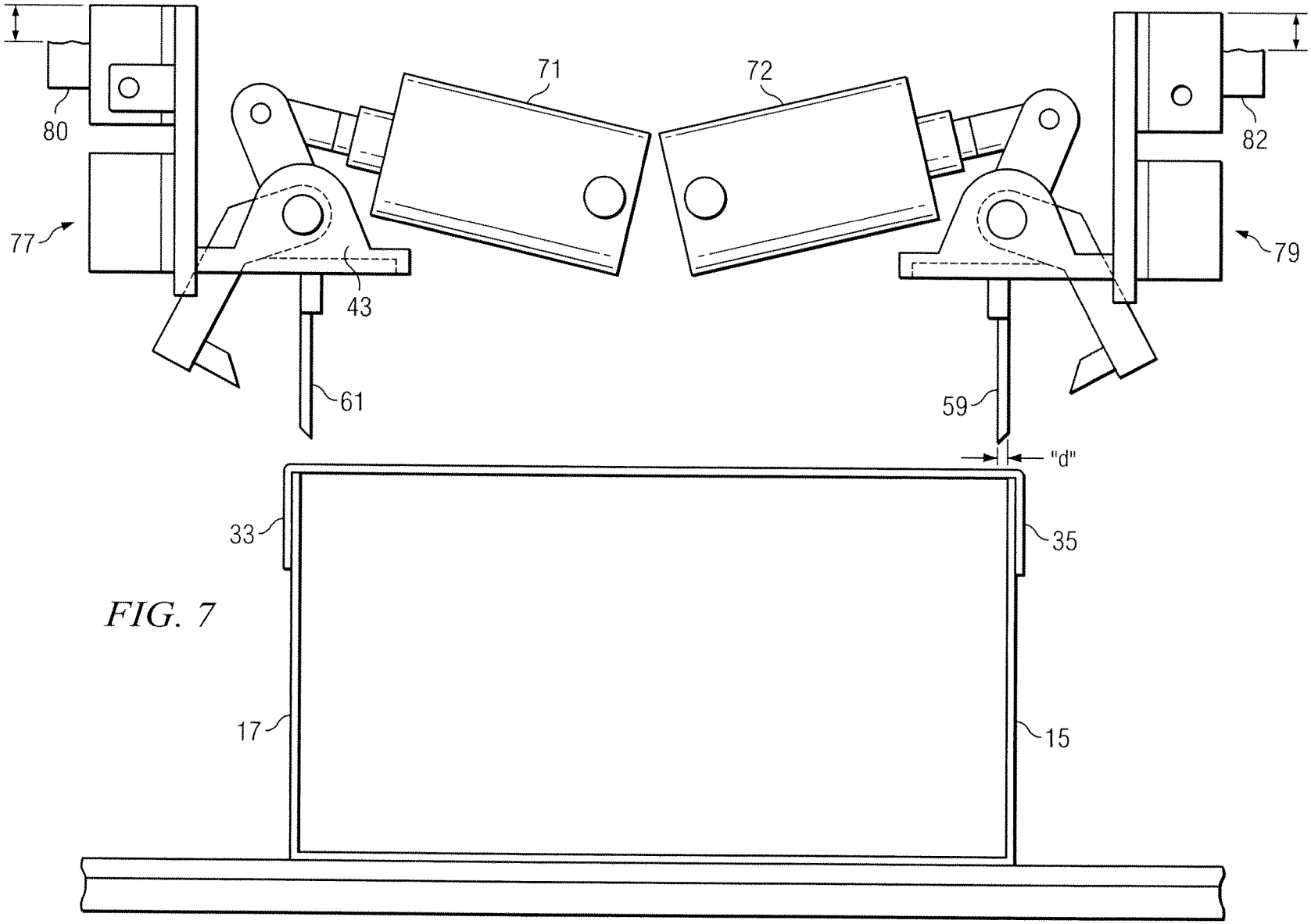
FIGS. 7-9 are simplified, schematic views of the various sequential steps in the method of the invention, showing the operative parts of one version of the carton punching mechanism of the invention.
Figure 8:
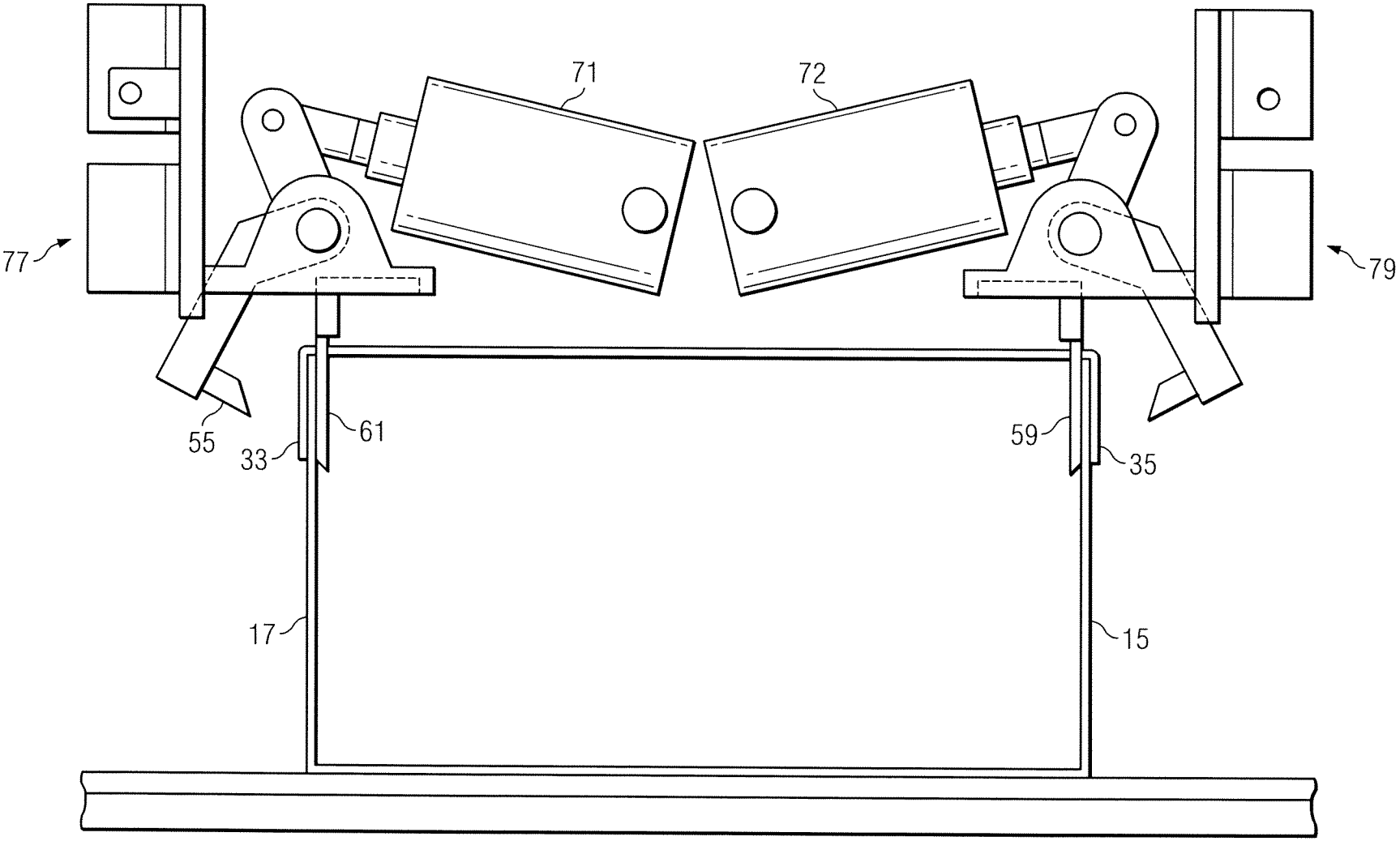
Figure 9:
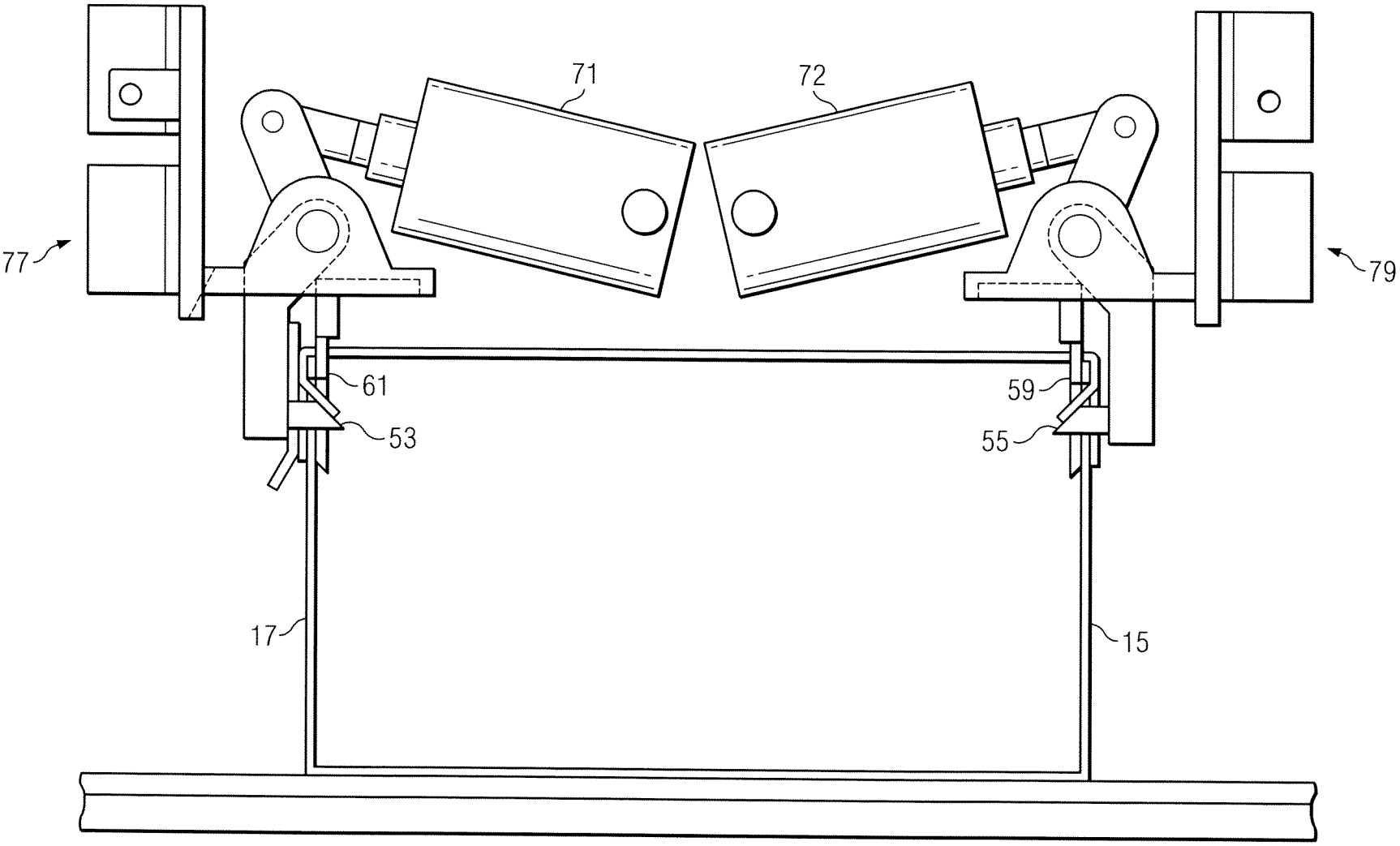
Figure 10:
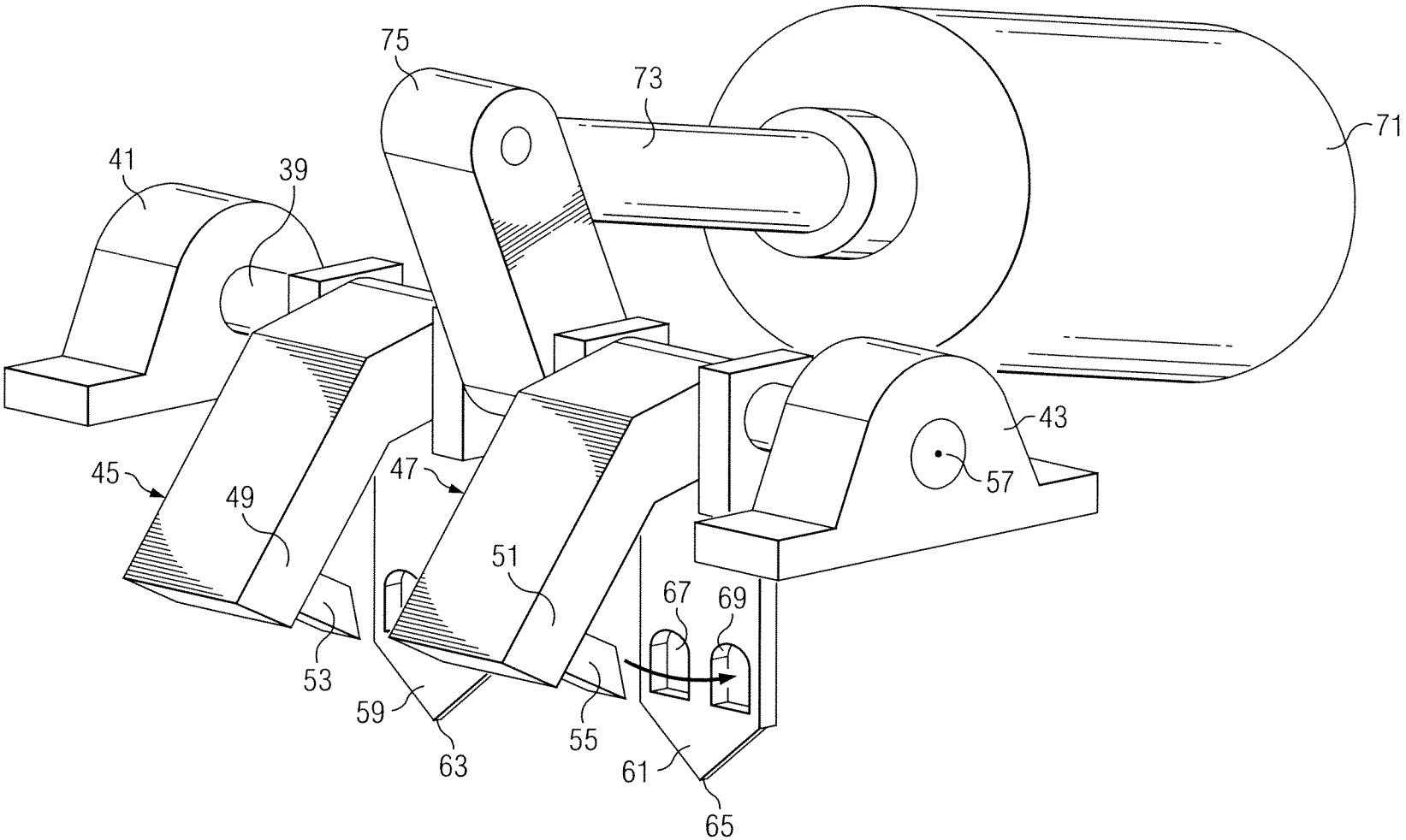
FIG. 10 is an isolated, close up view of the first version of the carton punching and engaging apparatus of the invention.
Figure 11:
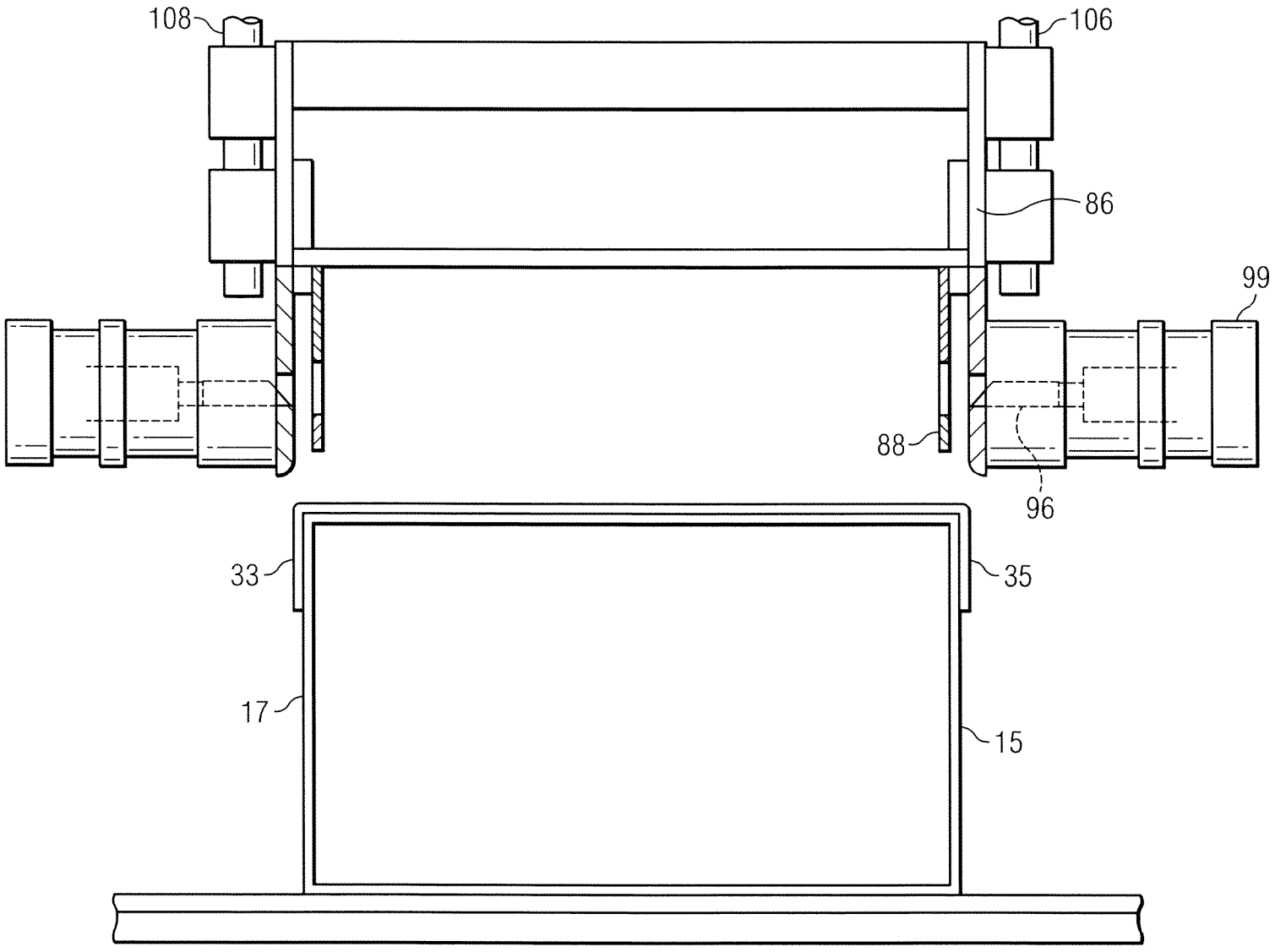
FIGS. 11-13 are simplified, schematic views of the various sequential steps in the method of the invention, showing the operative parts of a second version of the carton punching mechanism of the invention.

FIGS. 7-9 illustrate the principal components of one version of the carton closure station of the invention, as well as the various method steps employed in securing the carton top flaps. FIG. 10 is an isolated view of only the operative components of the first version of the closure mechanism of the invention. Thus, as illustrated in FIG. 7, the carton closure station of the invention is designed for receiving a cardboard carton of the type previously described with open top flaps which have been folded downwardly from an initially open position to a carton closing position which closes off the initially open interior of the cardboard carton. The outwardly extending ears (33, 35 in FIG. 7) of the now closed top flaps are also now folded down into a position in contact with a second set of opposing sidewalls 15, 17 of the carton intermediate the first set of opposing sidewalls 19, 21.

As will be apparent in the description which follows, the carton closing station has a carton punching mechanism for punching and forcing a first layer of cardboard from a respective top flap through an associated second layer of an underlying sidewall of the carton, whereby the second layer of cardboard forms a retainer for the respective flap ear to thereby secure the ear and flap to the respective sidewall of the carton.

FIG. 10 perhaps best illustrates the operative components of a first version of the carton punching mechanism of the invention. The punching mechanism includes a horizontal shaft 39 which is carried between a pair of spaced apart trunnions 41, 43. The shaft also carries a set of rotatable punches 45, 47 which are alignable with the now folded ears of the top flap of the carton, as will be further described. The rotatable punches 45, 47 have angularly bent, downwardly extending legs 49, 51 which terminate in inwardly extending die elements 53, 55. The die elements are in the nature of sharp teeth, capable of punching through at least two layers of cardboard. As will be apparent from the discussion which follows, the downwardly extending legs 45, 47 are rotatable about a pivot point or axis (generally at 57 in FIG. 10) for moving the die elements in an arcuate path both toward and then away from selected sidewalls of the carton.

As illustrated schematically in FIGS. 7-9, this version of the apparatus of the invention also includes an elevation mechanism for moving the punching mechanism with its rotatable punches along a vertical path of travel with respect to the carton located in the punching station. FIG. 7 illustrates the elevation mechanism as including vertically traveling carriages 77, 79 which are afixed to the trunnions (43 in FIG. 7). The carriages can be moved in a vertically reciprocal fashion by any suitable power means. The power means is illustrated schematically by the lower ends of the hydraulic cylinder shafts 80, 82, shown broken away in FIG. 7. However, the cylinder shafts 80, 82 are shown for illustrative purposes only and should not be deemed limiting. Virtually any method or device known for vertically moving the punching mechanism can be utilized. These include but are not limited to hydraulic, pneumatic, and other mechanical devices for vertically moving a mechanism.

The traveling carriages also support a pair of spaced apart, vertically extending platens (59, 61 in FIGS. 7-10). The platens, in one embodiment, are stationarily mounted with respect to the horizontal shaft 39 and have sharpened downwardly extending points 63, 65. The platens 59, 61 also are provided with window openings, such as the openings 67, 69 shown in FIG. 10. The sharp points on the platens puncture the carton top upon downward vertical movement of the traveling carriages 77, 79. The platens 59, 61 are then located a selected distance inward within the box interior so as to underlie the inwardly extending die elements of the rotatable punches when the punch mechanism is thereafter actuated and the punches are rotated to punch the carton. As the punch elements rotate in the direction of the folded carton ears to punch first the carton ear and then the carton sidewall, the window openings 67, 69 underlie the punches and receive the inwardly extending die elements 53, 55 within the window openings. Thus the platens, in one embodiment, act as a backing to counteract the force of the punches. The platens, in one embodiment, provide sufficient backing to allow the material, such as cardboard, to be cut cleanly and without tearing or bending of the box.

In similar fashion, any suitable operational means may be provided for effecting operative, rotational movement of the punches and withdrawing action of same within a predetermined desired period. Such means may comprehend circuitry involving microswitches, etc., but such do not constitute a part of the present invention. It will, of course, be well understood that the pivoting action of the punches and reciprocal vertical travel or stroke of the entire assembly may be effected by any well known means, such as pneumatic, hydraulic, electro-mechanical and, if need be, by manually operated mechanical expedients. However, for purposes of the present disclosure, the punches are shown as being rotated on the shaft 39 by means of hydraulic cylinders (71 shown in FIG. 10) having output shafts 73 which acts through a suitable linkage 75 to effect the rotation of the punches.

While only one of the punch mechanisms is illustrated in FIG. 10, it will be understood that typically four of such mechanisms will be used in order to secure a carton having the configuration shown in the present drawings.

The operation of the first version of the closure mechanism of the invention will now be described principally with respect to FIGS. 7-9. FIG. 7 shows the previously formed carton with the top flaps folded down and with the initially outwardly extending ears folded in. The closure mechanism is in its top point of its vertical path of travel. Note that the downwardly extending platens 59, 61 are spaced a selected distance ("d" in FIG. 7) inwardly so that the platens can be received within the carton interior underlying the interior sidewall of the carton and beneath the folded carton ears.

FIG. 8 illustrates the next step in the first method of the invention in which the elevation mechanism is actuated, causing the punch mechanism to travel vertically downward. This can be accomplished by vertical movement of the vertically traveling carriages 77, 79. This action causes the downwardly extending points 65, 67 of the platens to penetrate the plane of the top flaps of the carton and be received within the carton interior adjacent the respective vertical carton sidewall and beneath the now folded ears 33, 35.

In the next step in the method of the invention, the punch mechanism hydraulic cylinders 71, 72 are actuated, causing the punches to be rotated, whereby the die elements 53, 55 penetrate the carton ears and the carton sidewalls, as shown in FIG. 9. The operative steps would then be reversed to complete the carton closure operation. In other words, the die elements would be retracted from the carton sidewalls and the power source associated with the carriage assembly (such as a fluid cylinder) would be actuated to move the punching mechanism vertically upward and away from the carton.

FIG. 6 shows the completed carton. Note that the first layer of cardboard made up of the carton ears 29, 31 is punched through the second layer of cardboard 17 comprising the carton vertical sidewall and thereby forms a retainer for the respective ear to thereby secure the ear and flap to the respective sidewall of the carton.

While one embodiment has been described wherein the platens 59,61 are mounted upon the punching mechanism, and wherein the entire punching mechanism moves vertically, this is for illustrative purposes only and should not be deemed limiting. For example, in one embodiment the punching mechanism does not move vertically and instead only the platens 59, 61 move vertically independent of the punching mechanism. As will be discussed below, in some embodiments eliminating the need for the punching mechanism to move vertically decreases capital cost of the machine, reduces moving parts, and offers the ability to increase throughput. Allowing the platens 59, 61 to move independently from the punching mechanism allows the platens 59, 61 to function as described without requiring the punching mechanism to also move vertically.

Figure 12:
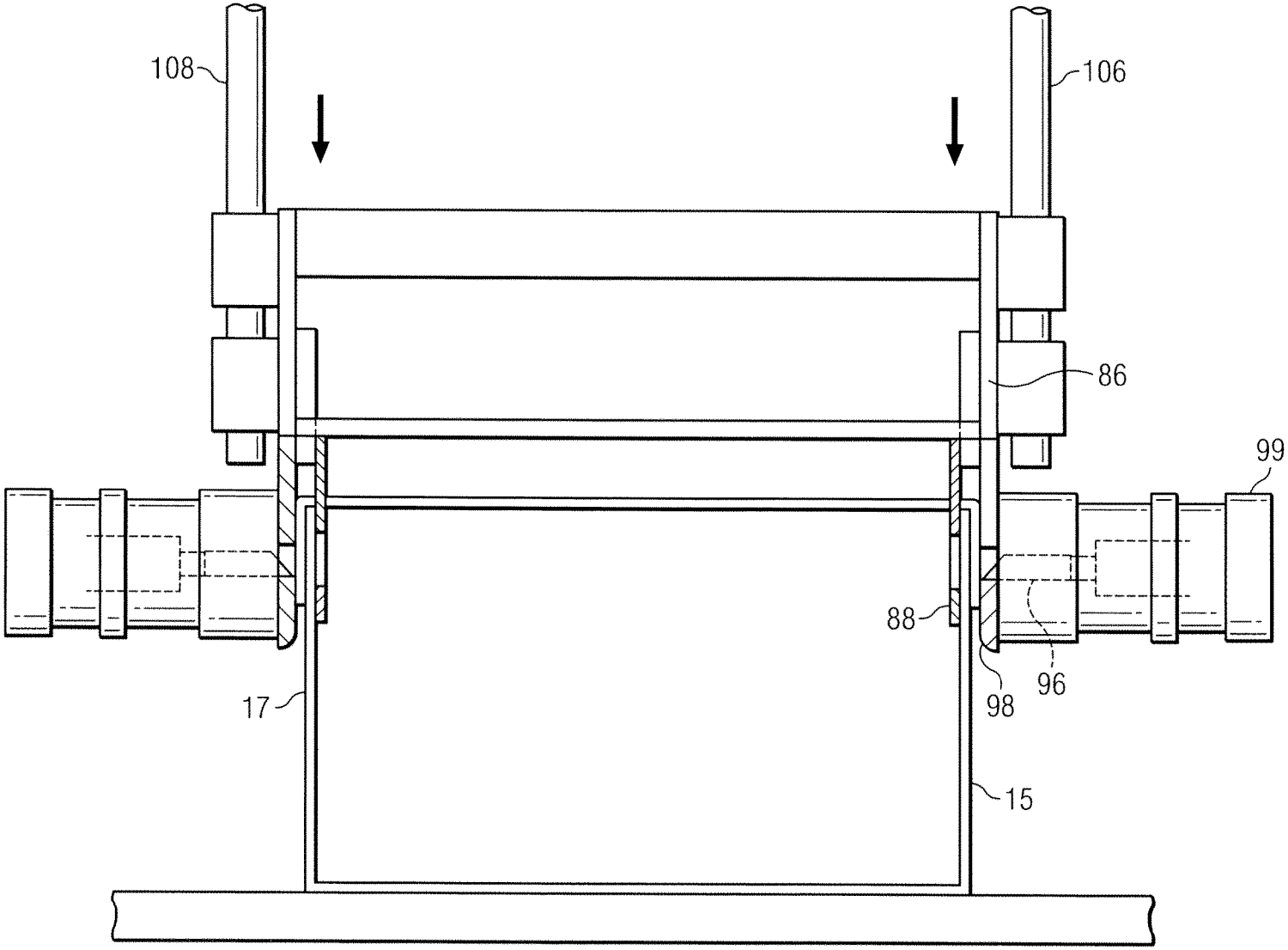
Figure 13:
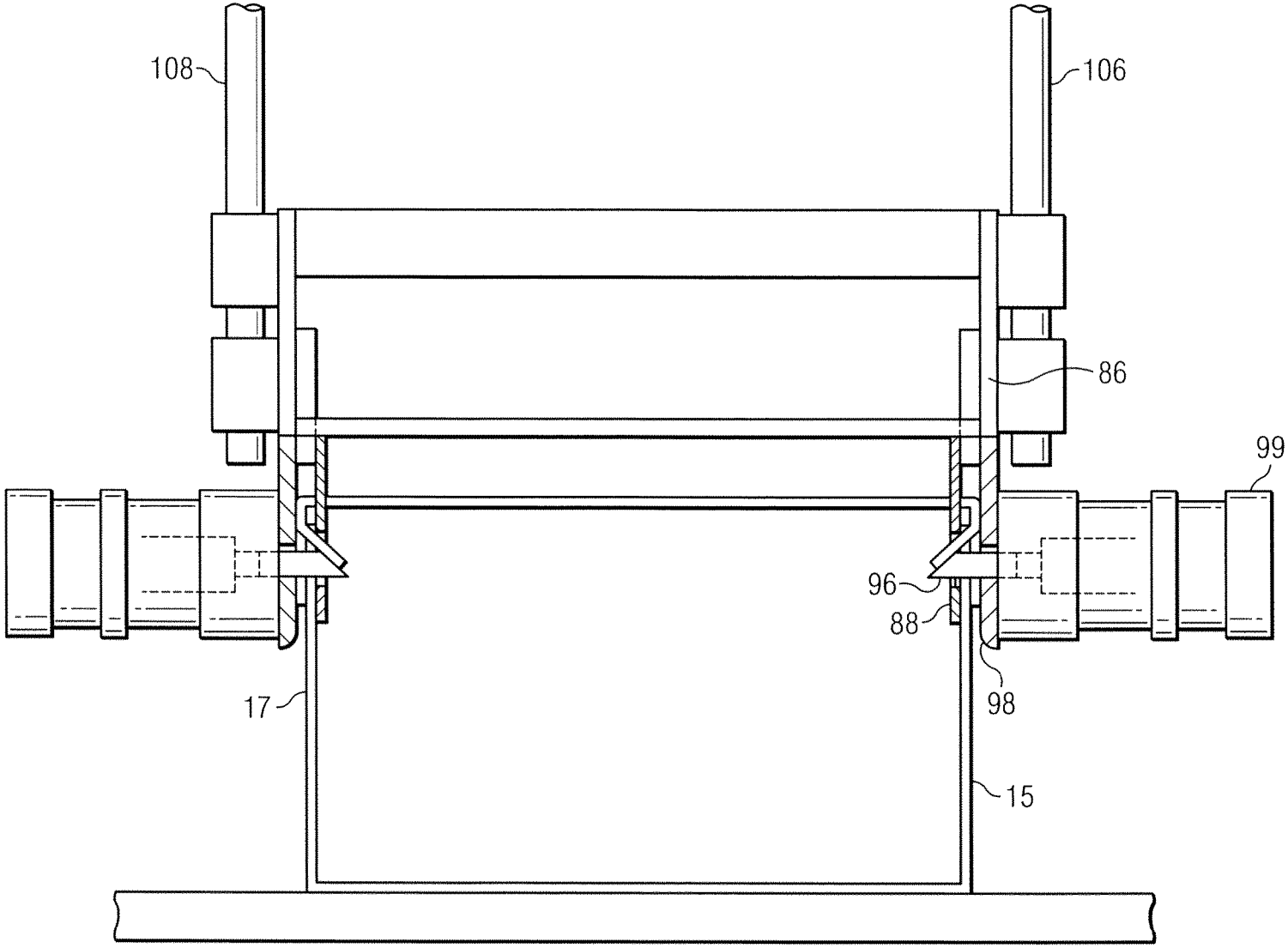
Figure 14:
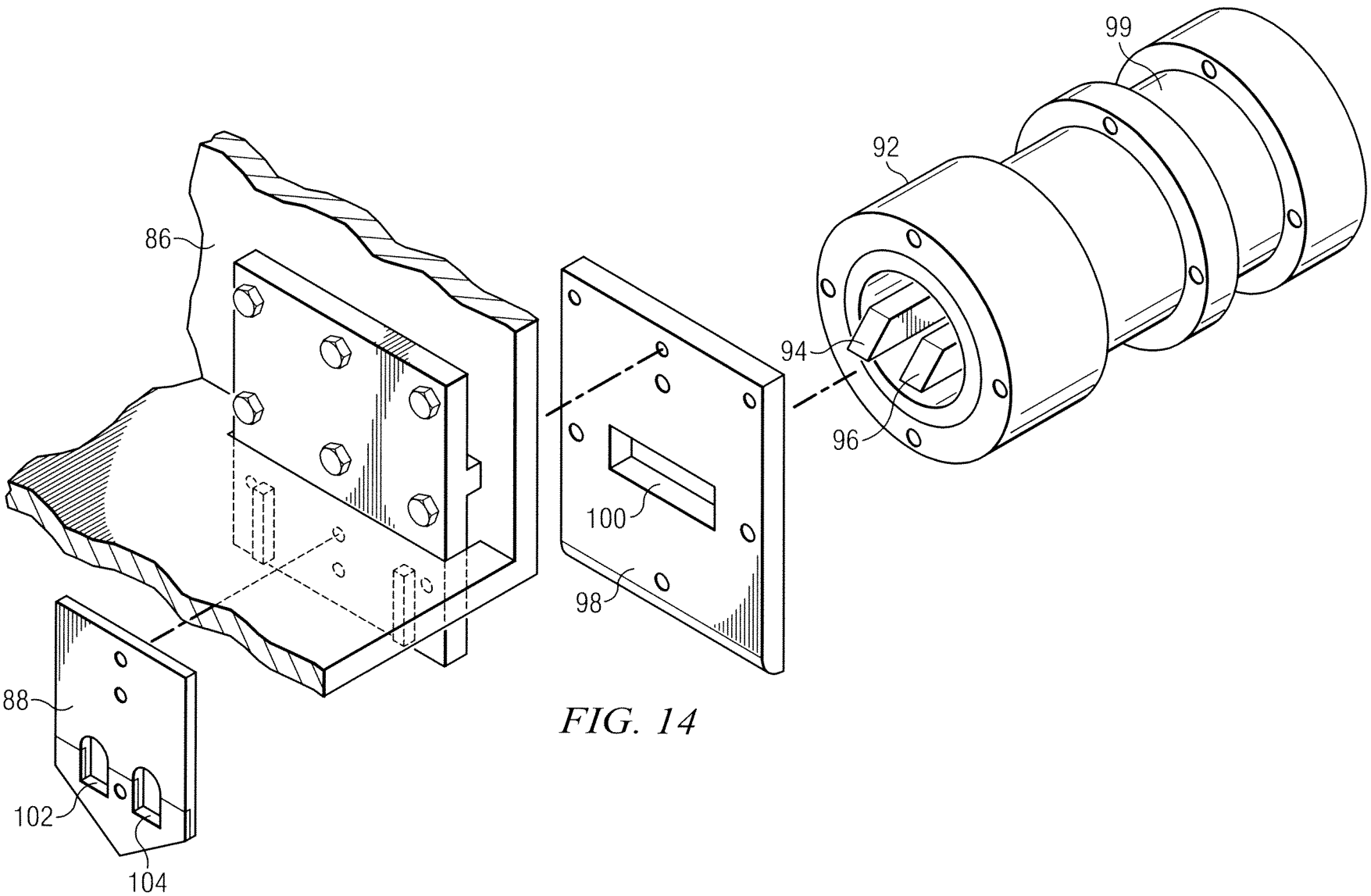
FIG. 14 is an isolated, close up view of the second version of the carton punching and engaging apparatus of the invention.

FIGS. 11-14 illustrate another version of the punching mechanism of the invention. With reference first to FIG. 14, the vertically movable carriage 86 again carries a pair of spaced apart, vertically extending platens (such as platen 88). In this case, however, a fluid cylinder 90 has an operative end 92 which carries the punch die elements 94, 96. A reinforcing plate 98 is located a selected distance opposite the platen 88 on the movable carriage. It has a horizontal slot 100 sized to receive the punch dies 94, 96. Actuation of the output shaft (shown in phantom lines in FIGS. 11-13) of the fluid cylinder 99 causes the punch die elements 94, 96, to move along a horizontal axis generally parallel to the bottom wall of the box. In this version of the invention, there is a simple linear back and forth action of the punches, rather than the previously described rotatable punching action. Otherwise, the two punching operations are substantially similar. The platen 88 again has window openings 104, 106, for receiving the punch die elements.

FIG. 12 shows the traveling carriage 86 supported on shafts 106, 108. Vertical, reciprocal movement of the shafts 106, 108, for instance in response to actuating a fluid cylinder, causes the assembly to move from the disengaged position shown in FIG. 11 to the carton engaging position shown in FIGS. 12 and 13. As the movable carriage moves vertically downward to the position shown in FIG. 12, the platens 88 puncture the carton top flaps so as to underlie the path of travel of the die elements 94, 96, as the carton closing operation proceeds.

FIG. 13 shows the punch die elements being actuated by the fluid cylinder 99. This action causes the punch die elements (94, 96 in FIG. 14) to punch the first layer of cardboard from a respective top flap, through the associated second layer of an underlying sidewall of the carton, and then through a respective opening in the underlying platen. In this way, the second layer of cardboard forms a retainer for the respective flap ear to thereby secure the ear and flap to the respective sidewall of the carton.

While a hydraulic system has been described, this is for illustrative purposes only and should not be deemed limiting. Virtually any device or method known to provide power or movement can be used. This includes, but is not limited to, servos, hydraulic systems, pneumatic systems, counterweight systems, spring systems, Mechanical, and combinations thereof. As but one example, in one embodiment the punch can be mechanically coupled to the conveyor such that when the box reaches a predetermined location, the conveyor provides the force necessary to cause operation of the punches. For example, the conveyor forces the box to engage a spring loaded punch system which creates the punch in the box.

In one embodiment the boxes are precut or scored at the location of the punches. For example, in one embodiment the ears 29, 31 comprise a score line. In another embodiment the sidewalls 17 will comprise a score line, while in other embodiments both the ears 29,31 and the sidewall 17 comprises a score line. A score line can refer to any line of weakness, either a perforation or a slight continuous cut. The score line can be created with any method or device known in the art including cutting with a laser, water, air, or other fluid, or with a traditional physical structure such as knife or blade. In one embodiment, the score line comprises the shape of the punch. As an example, referring to FIG. 6, the score line of the side wall 17 would comprise the depicted rectangular shape whereas the score line on the ears 29, 33 would have two vertical lines connected by a horizontal line at the bottom.

A score line reduces the amount of force required to make the punch. By requiring a comparatively reduced amount of force the punch can be made more quickly. Further, less backing is required to counteract the punching force. In some embodiments, the force is sufficiently reduced such that the platens discussed above are unnecessary. In such embodiments, this eliminates the need for the punching mechanism to move vertically to insert and remove the platens as discussed above herein. Instead, the punching mechanism can remain stationary, further reducing moving parts, capital costs, repair to equipment, etc. Further, if the punching mechanism remains stationary, as opposed to moving vertically, a comparatively higher throughput can be achieved. In such embodiments, the punching mechanism would remain stationary and operate to create the punches as previously described.

In some embodiments the punching mechanism does not use a die 53, 55 as described above. Instead, in one embodiment the punching mechanism utilizes a burst of air, water, nitrogen gas, carbon dioxide, or other fluid to provide the force necessary to cause the punch. The fluid can be delivered via a nozzle or other device to provide the necessary force. The pressure, velocity, and stream of the fluid can be adjusted to control the creation of the desired punch. In some embodiments, such as the embodiments discussed above wherein the sidewalls 17 and/or the ears 29, 31 comprise score lines, the punch can be created with a burst of air or other fluid. The box will be oriented as in FIG. 5, as previously discussed. However, instead of a physical die making contact, a burst of air will cause the outer ear 29, 33 to puncture the sidewall 17 to create the punch. A burst of air, or other such fluid, has the benefit of increased speed, reduced moving parts, etc. Further, using a burst of air or other such fluid reduces mechanical replacement cost as well as results in less maintenance down time.

As noted, in some embodiments a reduced force is required to impart the desired punch. In some embodiments, dependent upon the material used for the box and the required force, a platen may or may not be required. In some embodiments the system uses an external force rather than the internal force offered by the platens to counteract the force of the punch mechanism. In still other embodiments, the box may comprise sufficient inherent rigidity that the platens are unnecessary.

The apparatus and method discussed herein can be used on virtually any punchable material. These include, but are not limited to, cardboard, plastic, metal, wood, etc.

The boxes can be used to store virtually any consumer good. As illustrated above, in one embodiment the boxes are used to hold other separately packaged items, such as milk cartons. However, in other embodiments the boxes store items which are not separately packaged items such as unpackaged books. In still other embodiments the outer box serves as an outer package yet there is a separate inner package such as so-called bag in a box packages. For example, the system and method can be used on typical cereal boxes whereby the punch closes the outer cardboard box. However, the cereal box would further comprise a separately sealed bag which contains the cereal.

In one embodiment the punching mechanism is adjustable so as to provide punches on various sized packages. As an example, if a first box has punches located at a height of six inches, then the punching mechanism can be adjusted to produce a second box which has punches located at a height of one foot. Likewise, in one embodiment, the distance between the platen and the punches can be adjusted to tolerate material of various thicknesses. Thus, if a thicker cardboard, for example, was being utilized, the distance between the platen and the punches can be increased. Taken further, in some embodiments, the stroke of the punching mechanism, and/or the length of the die element 53,55, for example, can be adjusted to account for thicker material. If a thicker cardboard was utilized, the distance that the die elements 96 travels can be increased to account for the thicker cardboard. These and other quick change abilities afford the punch mechanism increased flexibility. Users can quickly modify the punch mechanism to accept thicker cardboard, larger boxes, and the like.

An invention has been provided with several advantages. The use of a punch mechanism in the carton closure method of the invention eliminates the need for gluing the carton top. This saves money on glue and also reduces the mess associated with the gluing operation. In many packaging operations glue is one of the most expensive items, often costing as much or more than the cardboard. Accordingly, eliminating the glue offers considerable material cost savings.

Aside from material costs, the method and apparatus reduces capital cost. The glue machinery requires a significant capital investment. Further, the glue machinery often requires substantial maintenance and repair costs. The maintenance includes the top sealer malfunctioning, mechanical issues, clogged nozzles, glue clean up issues, glue splatter causing mechanical issues, elimination of personal burning, etc. The repair and capital costs can be avoided with the system and method discussed herein. Further, the glue requires tact time to allow the glue to dry and adhere. Depending upon the glue, 8 feet or more of the conveyor space is set aside to allow time for the glue to dry. Such tact time can be eliminated with the method and system discussed herein.

Another advantage, in some embodiments, the ability to provide a reusable box. When using glue, the cardboard, for example, must often be ripped or torn to gain entry into the box, rendering the box unusable. However, in some embodiments, the punches can be removed, without damaging the box. To do so, the punch process is reversed by removing the punched in flap from the outer layer from the window. The box can then be opened. The box can be reclosed by again punching the flap through the window. Depending upon the material, the box can be reclosed several times. This ability decreases waste and increases the life of the box. Put differently, what was once a one time and then discard box can now be used multiple times. This has several environmental as well as economic benefits.

The mechanism of the invention is relatively simple in design and economical to implement and can be incorporated into a variety of existing packaging lines. The use of underlying platens reduces any tendency of the punch mechanism to bend or deform the carton and reduces the risk that any contents of the carton might be damaged during the top sealing operation. Because no glue is used, the punched carton regions can be opened and then resealed by hand.

While the invention has been shown in only one of its forms, it is not thus limited but is susceptible to various changes and modifications without departing from the spirit thereof.

ADDITIONAL DESCRIPTION

The following clauses are offered as further description of the disclosed invention.

Clause 1. A method for closing a carton where the carton has a bottom wall and integral sidewalls extending upwardly therefrom to define an initially open interior, the carton also having a top, the top having downwardly extending ears which have been brought to a position in contact with selected ones of the carton sidewalls with the sidewalls underlying the downwardly extending ears, the method comprising the steps of:

providing a carton closing station for the aforesaid carton for temporarily supporting the carton in a stationary position within the closing station;

providing a punching mechanism including at least one punch at the carton closing station which is alignable with the downwardly extending ears of the carton top;

aligning said at least one punch with the downwardly extending ears of the carton top and actuating the at least one punch to form at least one punch opening and to force a first layer of said carton from a respective top ear through an associated second layer of an underlying sidewall of the carton, whereby the second layer of carton and forms a retainer for the respective carton ear to thereby secure the carton ear to the respective sidewall of the carton.

Clause 2. The method of any proceeding or preceding claim wherein the punching mechanism includes at least one vertically extending platen which underlie the punch as the punch is actuated to puncture the carton, the platens having window openings for receiving operative portions of the punch while, at the same time, reinforcing the carton sidewalls.

Clause 3. The method of any proceeding or preceding claim wherein said punch comprises a burst of fluid.

Clause 4. The method of any proceeding or preceding claim wherein said carton comprises score lines located on said downwardly extending ears and on said sidewall underlying the downwardly extending ears.

Clause 5. The method of any proceeding or preceding claim wherein said closing does not require glue on said top.

Clause 6. An assembly line mechanism for closing a carton where the carton has a bottom wall and integral sidewalls extending upwardly therefrom to define an initially open interior, the carton also having a top, the top having downwardly extending ears which have been brought to a position in contact with selected ones of the carton sidewalls with the sidewalls underlying the downwardly extending ears, the assembly line mechanism comprising:

a carton closing station for the aforesaid carton for temporarily supporting the carton in a stationary position within the closing station;

a punching mechanism provided as a part of the carton closing station, the punching mechanism including at least one punch which is alignable with the downwardly extending ears of the carton top, the punch being movable along a horizontal axis, generally parallel with the carton bottom wall, between retracted and extended positions; and the shaft carrying the punches, whereby actuating the punches to move between the retracted and extended positions forms punch openings while simultaneously forcing a first layer of carton from a respective carton ear through an associated second layer of an underlying sidewall of the carton, whereby the second layer of carton forms a retainer for the respective carton ear to thereby secure the carton ear to the respective sidewall of the carton.

Clause 7. The assembly of any proceeding or preceding claim further comprising a set of spaced apart, vertically extending platens which underlie the punch as the punch is actuated to puncture the carton, the platens having window openings for receiving operative portions of the punch while, at the same time, reinforcing the carton sidewalls.

Clause 8. The assembly of any proceeding or preceding claim wherein said punching mechanism is stationary.

Clause 9. The assembly of any proceeding or preceding claim wherein said punching mechanism moves vertically up and down relative to said carton.

Clause 10. The assembly of any proceeding or preceding claim wherein said platens move vertically independently from said punching mechanism.

Clause 11. An assembly line mechanism for closing a carton where the carton has a bottom wall and integral sidewalls extending upwardly therefrom to define an initially open interior, the carton also having a top, the top having downwardly extending ears which have been brought to a position in contact with selected ones of the carton sidewalls with the sidewalls underlying the downwardly extending ears, the assembly line mechanism comprising:

a carton closing station for the aforesaid carton for temporarily supporting the carton in a stationary position within the closing station;

a punching mechanism provided as a part of the carton closing station, the punching mechanism including at least one nozzle which is alignable with the downwardly extending ears of the carton top; and whereby fluid sprays from said nozzle to form punch openings while simultaneously forcing a first layer of carton from a respective carton ear through an associated second layer of an underlying sidewall of the carton, whereby the second layer of carton forms a retainer for the respective carton ear to thereby secure the carton ear to the respective sidewall of the carton.

Clause 12. The assembly of any proceeding or preceding claim wherein said carton comprises score lines located on said downwardly extending ears.

Clause 13. The assembly of any proceeding or preceding claim and on said sidewall underlying the downwardly extending ears.

Clause 14. The assembly of any proceeding or preceding claim wherein said carton comprises plastic.

What is claimed is:

1. A method for closing a carton where the carton has a bottom wall and integral sidewalls extending upwardly therefrom to define an initially open interior, the carton also having a top, the top having downwardly extending ears which have been brought to a position in contact with selected ones of the carton sidewalls with the sidewalls underlying the downwardly extending ears, wherein said carton comprises score lines located on and within said downwardly extending ears, wherein said score lines form the shape of a punch opening, wherein said punch opening is located within the confines of each downwardly extending ear, the method comprising the steps of:

applying a force to form at least one punch opening and to force a portion of said downwardly extending ears defined by said score lines through an associated second layer of an underlying sidewall of the carton, whereby the second layer of carton and forms a retainer for the respective carton ear to thereby secure the carton ear to the respective sidewall of the carton, and wherein a portion of said downwardly extending ears remains atop said underlying sidewall, further comprising a punching mechanism which includes at least one vertically extending platen which underlie the punch as the punch is actuated to puncture the carton, the platens having window openings for receiving operative portions of the punch while, at the same time, reinforcing the carton sidewalls.

2. The method of claim 1 wherein said force comprises a burst of fluid.

3. The method of claim 1 wherein said carton further comprises score lines located on said sidewall underlying the downwardly extending ears, wherein said score lines on said sidewall align with said score lines on said downwardly extending ears, and wherein said portion of said downwardly extending ears defined by said score lines are forced through said underlying sidewall at said score lines on said sidewall.

4. The method of claim 3 wherein said closing does not require glue on said top.

5. The method of claim 1 wherein said force comprises force applied by a human hand.

6. The method of claim 1 further comprising providing a punching mechanism including at least one punch at the carton closing station which is alignable with the downwardly extending ears of the carton top; and aligning said at least one punch with the downwardly extending ears of the carton top and actuating the at least one punch to form said at least one punch opening.

7. The method of claim 6 wherein said punching mechanism is stationary.

8. The method of claim 6 wherein said punching mechanism moves vertically up and down relative to said carton.

9. The method of claim 6 wherein said platens move vertically independently from said punching mechanism.

10. The method of claim 1 wherein the top has two flaps which are integrally made with said sidewalls, and wherein each of said flaps comprises a pair of said downwardly extending ears, wherein said pair of downwardly extending ears are spaced-apart.

* * * * *